United States Patent [19]

Foster

[11] 4,117,702

[45] Oct. 3, 1978

[54] ROLLING MACHINES FOR CONTOURING TAPERED STRUCTURAL MEMBERS

[75] Inventor: Gene B. Foster, Seattle, Wash.

[73] Assignee: The Boeing Company, Seattle, Wash.

[21] Appl. No.: 803,683

[22] Filed: Jun. 6, 1977

[51] Int. Cl.[2] ..... B21D 7/08; B21D 7/14

[52] U.S. Cl. ..... 72/7; 72/21; 72/8; 72/173

[58] Field of Search ..... 72/166–175, 72/6, 7, 21, 240, 189, 190, 194, 187

[56] References Cited

U.S. PATENT DOCUMENTS

| | | | |
|---|---|---|---|
| 3,535,903 | 10/1970 | Abernathy et al. | 72/181 |
| 3,557,593 | 1/1971 | Bollig et al. | 72/240 |

*Primary Examiner*—Milton S. Mehr

*Attorney, Agent, or Firm*—Christensen, O'Connor, Johnson & Kindness

[57] ABSTRACT

Pinch and pyramid roll forming machines for contouring elongate, tapered structural members are disclosed. Each of the rolls of the pinch and pyramid roll forming machines is segmented and selected segments are mounted such that they are transversely position adjustable with respect to their axis of rotation. The positions of the position controllable segments are controlled by power operated, transversely movable cages that surround a portion of these segments. In pinch roll forming machines, other, corresponding, selected segments of the pinch rolls are semi-floating and follow the movement of the position controllable segments. In both types of machines, the segmented roll arrangement results in the ability to control the roll profiles so that they match the cross-section of a tapered part as it is being contoured.

18 Claims, 11 Drawing Figures

Fig. 1.
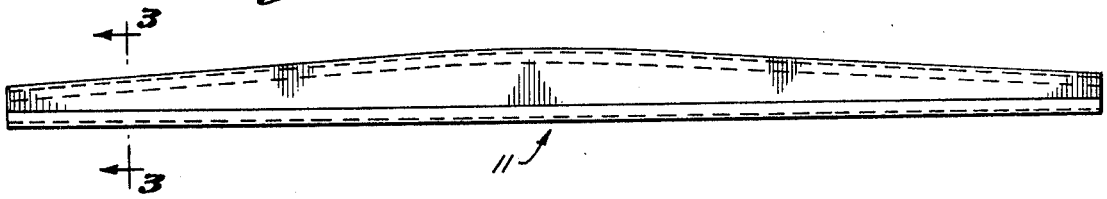
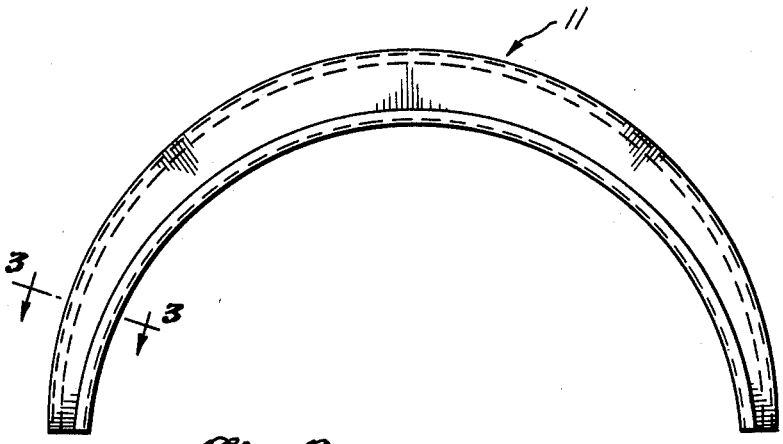
Fig. 2.
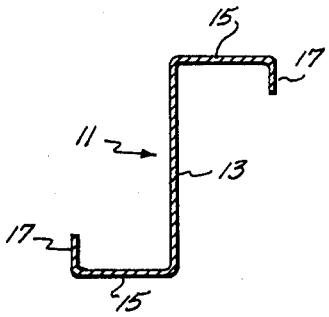
Fig. 3.
Fig. 4.
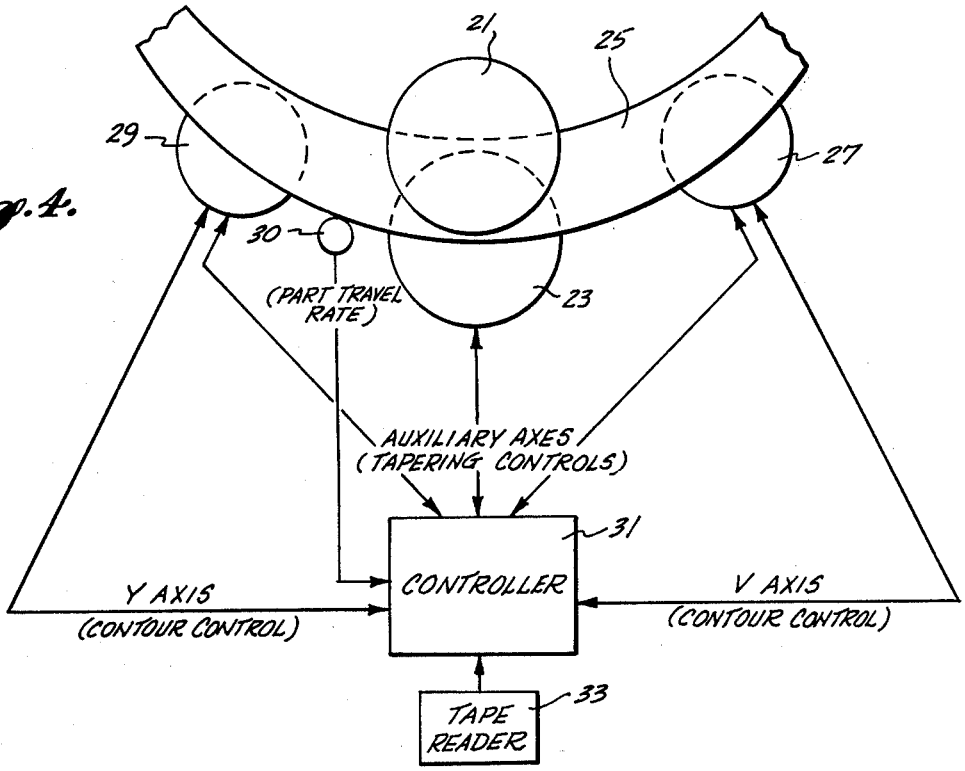

Fig. 10.
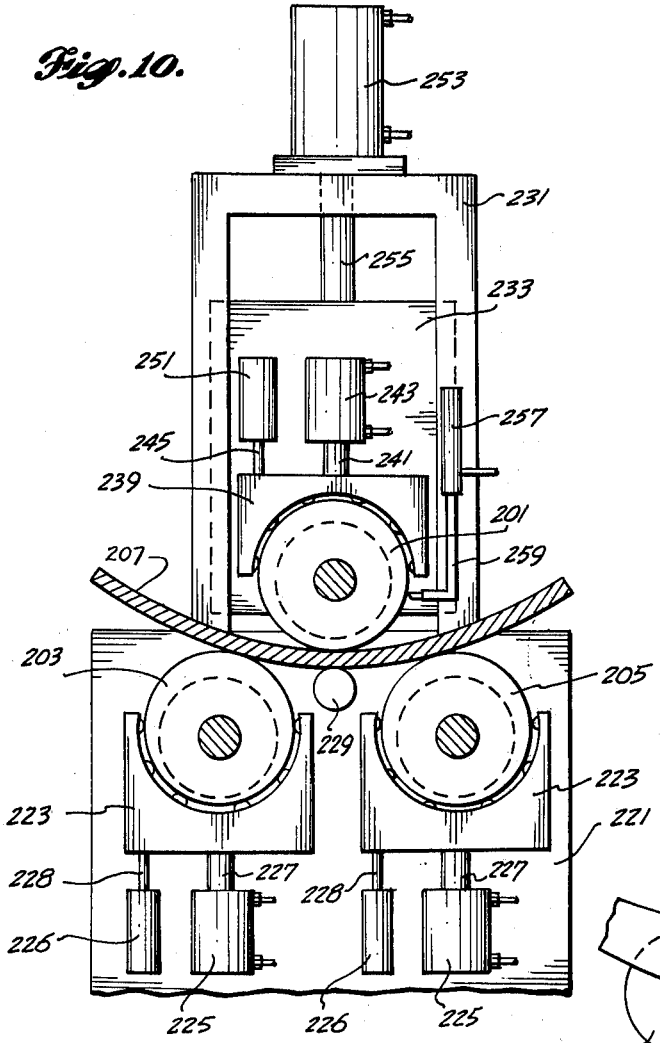
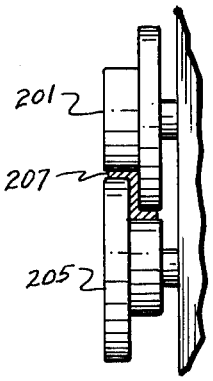
Fig. 11.
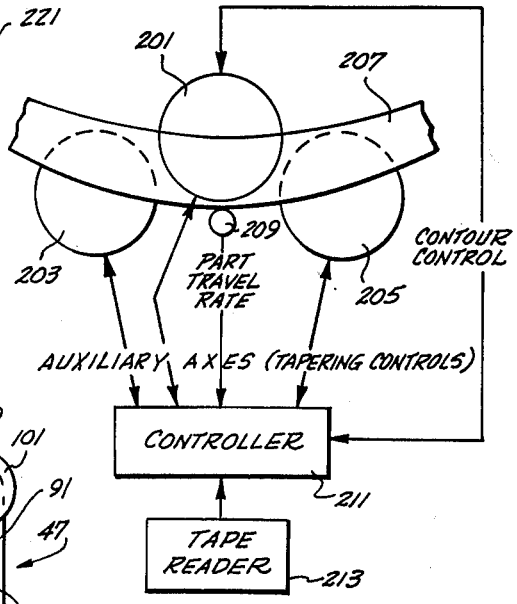
Fig. 9.
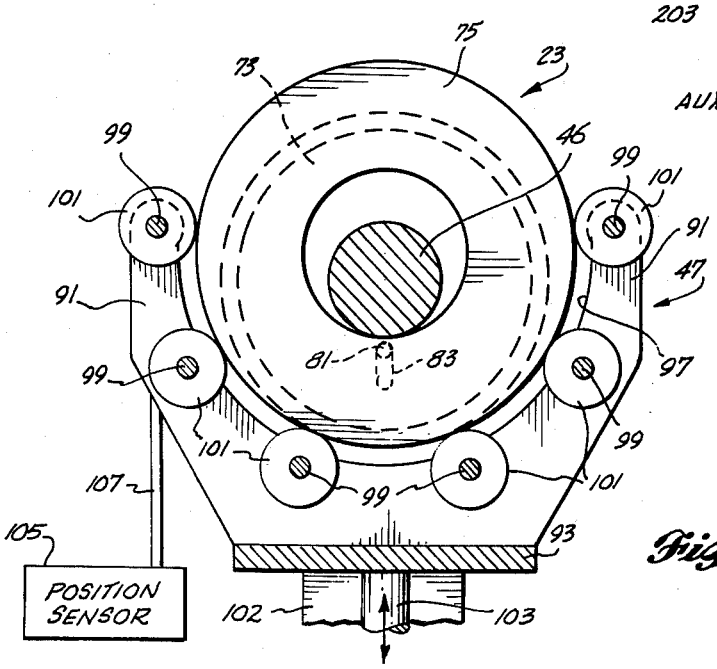
Fig. 7.

ROLLING MACHINES FOR CONTOURING TAPERED STRUCTURAL MEMBERS

BACKGROUND OF THE INVENTION

This invention is directed to roll forming machines and, more particularly, to pinch and pyramid roll forming machines.

Tapered structural members are used in a variety of different environments. In many cases, as well as being tapered, structural members must also be contoured. For example, large transport aircraft utilize sheet metal structural members in the form of stringers, longerons and frames. For optimum structural efficiency, the section modulus of these structural members (based on section height and thickness) must vary to suit loading conditions. That is, if the section modulus is highest where the load is greater and lower when the load is less (as opposed to a continuous section modulus based on the maximum loading capacity), maximum weight efficiency is obtained. In this regard, since an airplane body is loaded as a beam, stresses are highest at the crown and keel of the aircraft and diminish toward the forward and aft ends. As a result, in order to obtain maximum structural efficiency, stringers must have substantially greater height in the mid-region of the aircraft and frames must have a substantially greater height in the crown and keel areas. Both frames and stringers, of course, are normally contoured, i.e., curved.

In the past, tapered structural members, regardless of whether or not they were contour formed, were built from small pieces spliced together with associated doublers, fail safe members and fasteners, as necessary. Obviously, there are weight penalties associated with this approach, as well as undesirably high manufacturing costs. Recently, an apparatus for producing elongate, tapered structural members in a continuous manner has been developed. In this regard, attention is directed to U.S. Pat. No. 4,006,617 entitled "Method and Apparatus for Roll Forming Tapered Structural Members". While the method and apparatus described in this patent greatly reduces the weight and manufacturing costs attendant to the production of linear, elongate, tapered structural members, it does not solve the same problems with respect to contoured, tapered structural members.

In the past, structural members of continuous uniform cross-sectional geometry usually have been contour roll formed either by pinch roll forming machines or by pyramid roll forming machines. Each of these types of machines has advantages and disadvantages when compared to the other type. As a result each is more useful in some circumstances than the other.

A pinch roll forming machine comprises two vertically opposed matched pinch rolls and two outrigger or forming rolls, one on either side of the pinch rolls. The pinch rolls are driven and move the structural member as it is being contoured (curved). In addition, during forming, the pinch rolls restrain buckling in the critical forming area. The outrigger or forming rolls impart contour to the structural member or part as these rolls are progressively raised from an original in-line position. One advantage of pinch roll forming machines is the high degree of part confinement provided in the bending area. A further advantage is the high pinch roll pressure that can be utilized to thin part flanges located on the outer periphery of the contour in order to relieve compressive stresses on inner flanges. Pinch roll forming machines have the disadvantage that one more roll assembly is required (when compared to pyramid roll forming machines described below). Also, since more degrees of roll movement are involved, additional control axes mechanisms are required. In addition, heavy roll assemblies are required and, unless the forming rolls are driven, the possibility of part scuffing is high.

Pyramid roll forming machines comprise three driven rolls with two lower, in-line rolls supporting a structural member while it is being contoured (curved) by an upper, transversely adjustable, roll located midway between the two lower rolls, which are mounted for rotation in fixed positions. One advantage of pyramid roll forming machines is that they include fewer roll assemblies than do pinch roll forming machines; and only one roll is position controlled. Also, since all three rolls are driven, the possibility of part slippage and skidding during the part contouring operation is minimized. A disadvantage of pyramid roll forming machines is the lack of a high degree of part confinement in the critical forming area. As a result, such machines are not generally suitable for contouring thin, deep sections. Moreover, generally, pyramid roll forming machines are not as versatile as pinch roll forming machines. For example, they can only contour a part in a single plane, as opposed to contouring a part in two planes, or twisting a part as it is being contoured in one or more planes.

From the foregoing general summary of the nature and operation of pinch and pyramid roll forming machines, as noted above, it will be appreciated each machine has advantages and disadvantages. As a result, the nature of the part to be contour formed and the number to be formed generally dictates the type of machine that will create the desired contour in the required number of parts in the least expensive manner.

One disadvantage of both pinch and pyramid roll forming machines, and the disadvantage to which the present invention is primarily directed, relates to their inability to contour form elongate, tapered structural members. More specifically, in the past, pinch and pyramid roll forming machines were suitable for contouring structural members only if the member or part was of constant cross-section such that the rolls could be machined or assembled from segments to a profile closely matching the part cross-section. This arrangement is necessary to optimize confinement of the part shape particularly in the critical bending area. If this requirement is not met, the higher stressed regions of the member are free to buckle and distort during contouring. Because the rolls are of constant profile, the overall machines lack the flexibility to contour tapered structural members i.e., structural members of varying height.

Therefore, it is an object of this invention to provide a new and improved pinch roll forming machine.

It is another object of this invention to provide a new and improved pyramid roll forming machine.

It is also an object of this invention to provide a pinch roll forming machine suitable for contouring elongate, tapered structural members.

It is a further object of this invention to provide a pyramid roll forming machine suitable for contouring elongate, tapered structural members.

In the past, various proposals have been made to numerically control pinch and pyramid roll forming machines. (Numerical control means the controlling of the mechanically movable elements of such machines by a controller in accordance with numerical instructions stored in a suitable memory source, such as a punch tape, solid state memory, or magnetic cards or tapes and the like.) In this regard, attention is directed to U.S. patent application, Ser. No. 756,359 entitled "Pinch and Roll Forming. Assembly for Numerically Controlled Contour Forming Machines", filed Jan. 3, 1977 by Gene B. Foster, and U.S. Pat. Nos. 3,854,215, 3,906,765 and 3,955,389 for their disclosure of numerically controlled contour roll forming machines; and, U.S. patent application, Ser. No. 756,360, entitled "Numerically Controlled Pyramid Roll Forming Machine", filed Jan. 3, 1977 by Gene B. Foster, for its disclosure of numerically controlled pyramid roll forming machines. While the machines described in these patents and applications are advances in the state of the art of pinch and pyramid roll forming machines, they provide no mechanism for contouring elongate, tapered structural members.

Therefore, it is yet another object of this invention to provide an improved numerically controlled pinch roll forming machine suitable for contouring elongate, tapered structural members.

It is a still further object of this invention to provide an improvement numerically controlled pyramid roll forming machine suitable for contouring elongate, tapered structural members.

SUMMARY OF THE INVENTION

In accordance with aspects of this invention, pinch and pyramid roll forming machines for contouring elongate, tapered structural members are provided. Regardless of the type of machine, its rolls are formed such that the profile of the rolls is changeable to match part taper. The roll profile changing feature is provided by segmenting the rolls and mounting selected segments so that they are transversely position adjustable, with respect to their axis of rotation. The transverse positions of all of the selected segments are controllable in the pyramid roll forming machine. The transverse position of the selected segments of the forming rolls and one of the pinch rolls have their position controlled in the pinch roll forming machine. The selected segment of the other pinch roll is semi-floating and follows the movement of the position controllable segment of the first pinch roll. (Alternatively, the selected segments of both pinch rolls may be position controllable.) In either case, the segmented roll arrangement provides the ability to control the height of mating surfaces supporting the web and legs of a structural member as it is being contoured. As a result of this arrangement, roll forming machines formed in accordance with the invention include two types of controlled roll movement — (1) movement within a roll assembly, transverse to the axis of rotation, to provide a changing roll profile to match part taper; and, (2) movement of roll assemblies with respect to other assemblies to provide part bending (contouring) action.

In accordance with other aspects of this invention, the position controllable segments are each partially surrounded by a transversely movable cage. The cages are power operated by suited mechanisms, such as a hydraulic actuators. In addition, position sensors are provided to sense the position of the transversely movable cages and, thus, the position of the position controllable, transversely movable, roll segments.

In accordance with further aspects of this invention, numerical control systems for controlling the position of the roll segments that match or follow part profile are provided. The position of these segments are controlled such the shape of the part is "followed" as the part moves through the machine. The control systems are integrated with the controller that controls the position of the roll assemblies along selected axes affecting part contour, i.e., the controllers that receive numerical control information from a suitable source, such as a tape reader and utilize this information to continuously control the position controllable roll assemblies of the machines along selected linear and rotational axes.

It will be appreciated from the foregoing summary that the invention provides improved pinch and pyramid roll forming machines. While pinch and pyramid roll forming machines are somewhat different in nature, both are improved such that either can be used to contour elongate, tapered structural members, even though one type of machine may be better than the other for a particular part size or thickness. Because movable segments, in essence, track or follow the shape of a structural member as it passes through a particular forming machine, the part cross section is supported over its entire height during contouring. As a result, the part is prevented from buckling or warping in an undesirable manner. Moreover, support is provided at critical bending areas during contouring. Not only will the rolls follow height changes occurring in the web of a part, changes in flange thickness are also followed.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is an elevational view of a return flange Z-shaped, elongate, tapered structural member prior to contouring;

FIG. 2 is an elevational view of a return flange Z-shaped structural member, similar to that illustrated in FIG. 1, after being contoured;

FIG. 3 is a cross-sectional view along line 3—3 of FIGS. 1 or 2;

FIG. 4 is a block diagram of a control system suitable for controlling a pinch roll forming machine in general and, in particular, the position of the position controllable segments of selected rolls of such a machine, in accordance with the invention;

FIG. 7 is an elevational view, partially in section, illustrating a portion of a cage mechanism suitable for use in controlling the position of the position controllable segments illustrated in FIG. 6;

FIG. 9 is a block diagram of a control system suitable for controlling a pyramid roll forming machine in general and, in particular, the position of the position controllable segments of the rolls of a pyramid roll forming machine, in accordance with the invention;

FIG. 10 is an elevational view of the rolls of a pyramid roll forming machine and a mechanical mechanism formed in accordance with the invention for controlling the position of position controllable segments of the pyramid rolls; and, FIG. 11 is a partial edge view of the rolls of the pyramid roll forming machine illustrated in FIG. 10.

DESCRIPTION OF THE PREFERRED EMBODIMENTS

Figure 5:
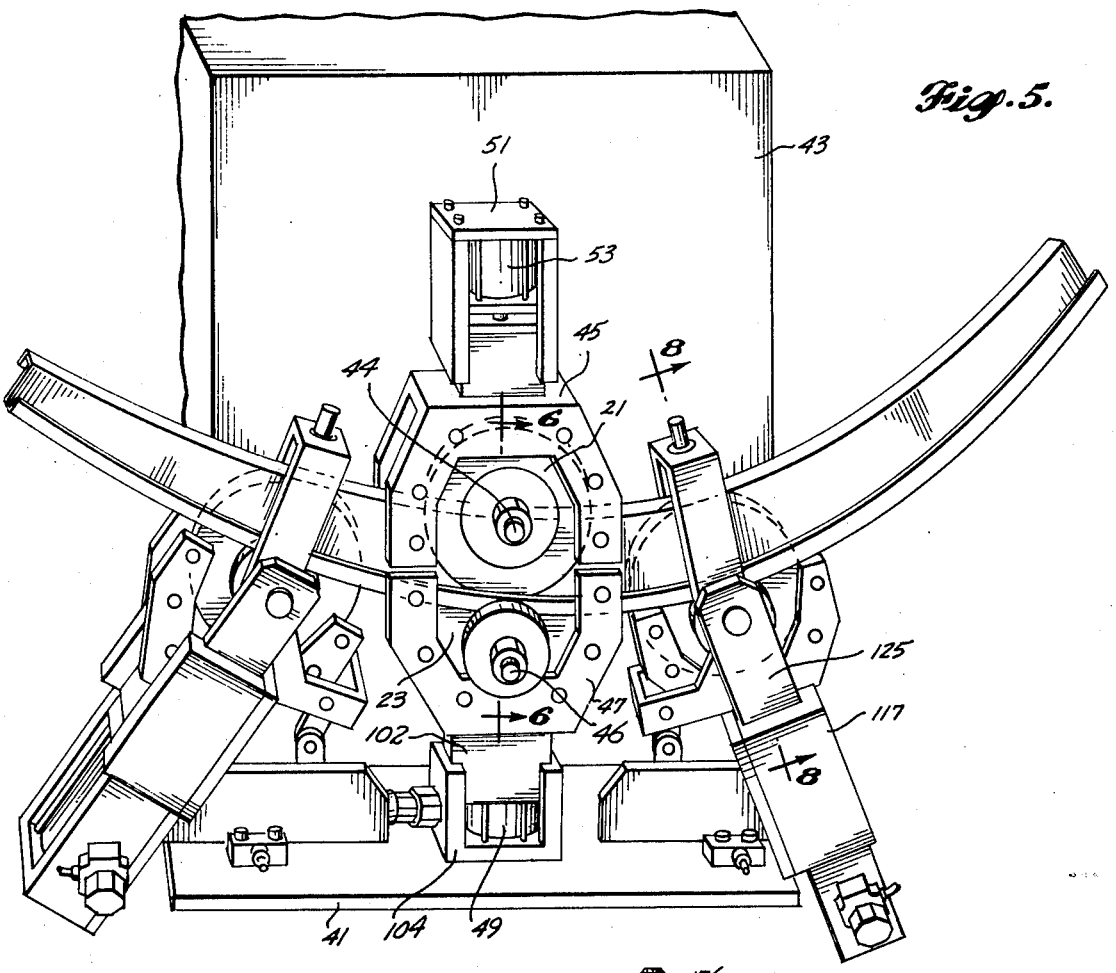
FIG. 5 is a pictorial view of a portion of a pinch roll forming machine mechanism, including roll segment position control mechanisms, formed in accordance with the invention.

FIG. 1 is a side elevational view of an elongate, linear, structural member 11. As illustrated in FIG. 3, the member 11 is a return flange Z-shaped member and includes a web 13, a pair of legs 15 and a pair of return flanges 17. The height of the web 13 varies along the longitudinal length of the member 11 and, the legs 15 project outwardly from opposite sides of the web, one at the top of the Web and the other at the bottom. For added stiffness, a return flange 17 is located at the outer end of each leg. Starting at one end, the web height first increases and, then, decreases; thus, the member 11 is "higher" in the center than on either end. (It will be appreciated that this particular height variation is exemplary only.)

As discussed above, machines suitable for forming structural members or parts of the type illustrated in FIG. 1 in straight lengths have been developed; however, roll forming machines suitable for contouring such structural members have not been available. That is, roll forming machines suitable for contouring structural members or parts wherein the height of the parts change along their longitudinal length have not been available. As a result, in the past, parts of the type illustrated in FIG. 1 have not been roll formed into the configuration illustrated in FIG. 2, for example. (FIG. 2 illustrates a circular structural element that is useful, for example, to form the crown or keel portions of a frame member of an aircraft fuselage.) The present invention is directed to improving pinch and pyramid roll forming machines so that they can be used to contour elongate, tapered structural members. In general, the invention accomplishes this result by segmenting the forming rolls of these machines and numerically controlling the transverse position (with respect to their axis of rotation) of selected segments as a part is being contoured.

FIG. 4 is a simplified block diagram illustrating a numerically controlled (N/C) pinch roll forming machine modified in accordance with the invention. Attention is directed to U.S. Pat. Nos. 3,854,215, 3,906,765 and 3,955,389 and application Ser. No. 756,359, all referenced above for a more detailed description of numerically controlled pinch roll forming machines. As will be readily understood from reviewing the cited patents and application, pinch roll forming machines include a pair of pinch rolls 21 and 23 mounted adjacent one another and rotated by a suitable power source. As the pinch rolls rotate, they move a part 25 past a pair of forming rolls 27 and 29, commonly referred to as right and left-hand forming rolls. The forming rolls are position adjustable with respect to a longitudinal or X-axis defined when the forming rolls are aligned with the pinch rolls. The part is contoured by the interaction between at least one of the forming rolls and the pinch rolls as the part moves through the machine. While various axes of forming roll position adjustment can be provided, both longitudinal and rotational, for purposes of clarity and because the various axes are not important to the present invention, FIG. 4 only illustrates movement of the forming rolls in a direction transverse to the direction of movement of the part. The illustrated axis of movement of the right-hand forming roll is denoted the V axis and the illustrated axis of movement of the left-hand forming roll 29 is denoted the Y axis. The forming roll position can remain constant or change as the part is moved through the machine, depending upon whether or not the contour is to be uniform throughout the length of the part, or variable. In any event, the rate of movement of the part through the machine is sensed by a part travel rate sensor 30, which may take the form of a shaft encoder. The rate information, and information from position sensors mounted so as to sense the position of the forming rolls, is applied to a controller 31. The controller 31 compares (at the rate of part travel) the sensed position information with desired position information produced by a tape reader or other suitable signal source 33. The continuous comparison produces error signals when a contour change is to take place. The error signals are used to control the position of the forming rolls 27 and 29. As a result, the positions of the forming rolls are changed in a manner such that the exiting part is contoured in the desired manner.

The present invention changes the system illustrated in FIG. 4 by forming the pinch and forming rolls of a plurality of segments, some of which are transversely position controllable with respect to their axis of rotation. Position sensors mounted so as to sense the position of the position controllable segments provide feedback information that is compared with the desired segment position information produced by the tape reader 33. The comparison is again performed at a rate determined by the rate of part movement, as sensed by the part travel rate sensor 30. The resultant error signals produced by the controller are used to control the transverse position of the position controllable segments independent of the position of the composite roll axis about which the segments rotate. Hence, the invention provides numerically controlled pinch roll forming machines wherein the position of roll segments are controlled as well as the position of the axis of rotation of the composite rolls formed by an assembly (e.g., two or more) of segments.

FIGS. 5–8 illustrate in detail the related portions of a mechanical mechanism of a pinch roll forming machine formed in accordance with the invention. FIG. 5 illustrates a base plate 41 and a vertical support plate 43, which may be the front face of a housing. The pinch rolls 21 and 23 are mounted on horizontal shafts 44 and 46 that are rotatably mounted in the vertical support plate 43, and extend outwardly therefrom. The upper and lower pinch rolls 21 and 23 are surrounded by upper and lower cages 45 and 47, respectively. The lower cage is affixed to the upper end of the vertically arrayed shaft of a hydraulic actuator 49, which is affixed to the base plate 41. The hydraulic actuator 49, thus, is adapted to raise and lower the lower cage 47. Obviously guide arrangements are needed to align and stabilize the cages. These arrangements are briefly discussed below.

As will be better understood from the following discussion, cage movement controls the position of a segment of an assembly of segments forming the lower pinch roll 23. Preferably, a suitable position sensor (not shown in FIG. 5) is provided for sensing the position of the lower cage 47 and, thus, the position of the position controllable segment of the lower pinch roll 23. A linear variable differential transformer (LVDT) or a linear potentiometer are examples of suitable position sensing devices.

The upper cage 45 is located beneath a bracket 51 attached to the vertical support plate 43. The bracket 51 supports either a hydraulic actuator 53 (illustrated) or a pressure source, such as a coil spring (not illustrated). Which of the two items is supported by the bracket 51 depends upon whether or not the position of a position controllable segments of an assembly of segmments forming the upper pinch roll is to be controlled or whether that segment is to merely follow the position of the position controllable segment of the lower pinch roll. In most cases, a hydraulic actuator is preferred, because parts are normally bent against the upper pinch roll. However, if a spring will provide force adequate to compensate for the required bending force, it may be used. In any event, the upper cage 45 is either connected to the lower end of the shaft of the hydraulic actuator 53 or mounted such that a suitable spring force presses the upper cage downwardly.

Figure 6:
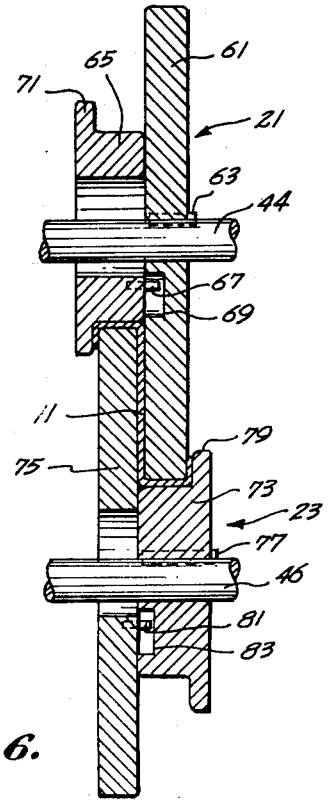
FIG. 6 is cross-sectional view along 6—6 of FIG. 5.

FIG. 6 is a cross-sectional view along line 6-6 of FIG. 5, illustrating the upper and lower pinch rolls 21 and 23. For purpose of clarity and better understanding, the upper and lower cages 45 and 47 are not illustrated. The upper pinch roll 21 comprises an assembly of two segments — an outer segment 61 and an inner segment 65 mounted side by side along the upper shaft 44. The outer segment is affixed to the upper shaft 44 by any suitable means, such as by a key 63 mounted in aligned keyways formed in the upper shaft and in the outer segment. The inner segment 65 is "floating" in the sense that it is transversely movable with respect to the upper shaft 44. In this regard, the diameter of the central aperture in the inner segment 65 is substantially larger than the diameter of the upper shaft 44. Even through transversely movable, the inner segment 65 is driven by the upper shaft 44 via a pin/slot arrangement connecting the inner and outer segments together. More specifically, a pin 67 affixed to the inner segment 65 lies in an elongate slot 69 formed in the outer segment 61. The longitudinal axis of the slot lies transverse to the axis of the upper shaft 44. As a result, as the upper shaft rotates the outer segment 61, the outer segment rotates the inner segment, regardless of the transverse position of the inner segment 65. Alternatively, the pin/slot arrangement can be omitted and the inner segment 65 driven by friction between it and the outer segment 61, and between it and the part 11.

In the illustrated embodiment of the invention, the outer segment 61 has an outer diameter substantially greater than the outer diameter of the inner segment 65. In addition, the inner segment 65 includes a radially extending flange 71 located at its inner face. The size and shape (profile) of the segments, of course, are dictated by the cross-sectional configuration of the structural member to be contour formed. In the illustrated embodiment, the member is a return flange Z-shaped member; and the shape and size of the described inner and outer segments are formed accordingly. However, it is to be understood that other sizes and shapes fall within the purview of the invention.

The lower pinch roll 23 also comprises an assembly of two side-by-side segments-an outer segment 73 and an inner segment 75. The diameter of the outer segment 73 is substantially smaller than the diameter of the inner segment 75. The outer segment is affixed to a lower shaft 46 by any suitable means, such as a key 77 lying in a pair of aligned keyways. The outer segment includes a radial flange 79 located at its outer face. The inner segment 75 of the lower pinch roll 23 is "floating" in the sense that it is transversely movable with respect to the axis of the lower shaft 46. In this regard, the diameter of the aperture in the inner segment 75 through which the lower shaft 46 passes is substantially larger than the diameter of the lower shaft. Even though transversely movable, the inner segment is driven by the lower shaft 46 as a result of a pin/slot arrangement connecting the lower segments together, or by friction. More specifically, a pin 81 projects outwardly from the outer face of the inner segments 75 and lies in an elongate slot 83 formed in the inner face of the outer segment 73. The longitudinal axis of the slot 83, of course, lies transverse to the axis of the lower shaft 46.

As noted above, the diameter of the shaft apertures in the inner segments 65 and 75 of both the upper and lower pinch rolls 21 and 23 are substantially larger than the diameter of the shafts about which they are mounted. Further, the space between the flanges 71 and 79 of the inner and outer segments 65 and 73, respectively, of the upper and lower pinch rolls 21 and 23 and the nearest face of the outer and inner segments 61 and 75, respectively of the upper and lower pinch rolls is equal to the width of the outer face of the legs 15 of the return flange Z-shaped member 11 to be contoured. Moreover, the thickness of the outer and inner segments 61 and 75, respectively, of the upper and lower pinch rolls 21 and 23 is equal to the distance between the return flanges 17 and the web 13 of the return flange Z-shaped member 11 to be contoured.

The upper and lower pinch rolls 21 and 23 are positioned such that the inner segment 75 of the lower pinch roll 23 is generally aligned with the region between the flange 71 of the inner segment 65 of the upper pinch roll 21 and the inner face of the outer segment 61. Similarly, the outer segment 61 of the upper pinch roll assembly 21 is aligned with the region between the outer face of the inner segment 75 of the lower pinch roll 23 and the flange 79 of the outer segment 73. As a result, an orifice in the shape of a return flange Z is formed between the upper and lower pinch rolls when they are appropriately spaced apart. It is through this orifice that the return flange Z-shaped member passes as it is being contoured.

It will be appreciated from viewing FIGS. 5 and 6 and the foregoing discussion that the inner segment 75 of the lower pinch roll 23 will be positioned so as to track or follow height changes occurring in the web of the return flange Z-shaped member as it is being contoured. The upward force created by web height changes will simultaneously cause the inner segment 75 of the upper roll 21 to track the top of the upper leg 15. The forces applied to the roll segments must be carefully balanced. The force applied to the upper 65 segment must be sufficient to resist the bending machine movement applied to the part by the forming rolls. The force applied to the lower position controlled segment 75 must exceed that applied to the upper segment so as to cause the upper segment to float with changing web height. As a result, the height of the orifice will change as part height changes. Hence, the orifice will continue to entirely surround and, thereby, restrain the part as it is being bent. The region encompassed by the pinch rolls is, of course, the critical bend area.

In addition to tracking the height of the web region, changes in leg thickness are also tracked. Upper leg thickness changes are tracked by the inner segment 65 of the upper roll 21 vertically changing its position. Lower leg thickness changes are tracked by changing the position of the upper shaft 44 with respect to the lower shaft. Still further, the leg flange can be thinned, if desired, by controlling the position of the upper and lower shafts. Such control results in controlling the application of a thinning force to the lower leg by the outer segments 61 and 73 of the pinch rolls.

FIG. 7 is an elevational, cross-sectional view, looking outwardly from the plane of the vertical support plate 43, illustrating the lower cage 47 and the lower pinch roll 23. Preferably the lower cage 47 is generally U-shaped. More specifically, the lower cage 47 includes a pair of parallel plates 91 affixed together along one edge by a cross member 93. Each plate includes a U-shaped aperture 97 slightly larger in diameter than the diameter of the roll segment whose position is to be controlled. The legs of the U-shaped apertures point away from the cross member 93.

Extending between the plates 91, about the U-shaped apertures, are a plurality of shafts 99. Mounted on each shaft 99 is a roller 101. The rollers 101 project beyond the edge of the U-shaped aperture 97 and are adapted to impinge on the lower, outer periphery of the segment 75 of the lower pinch roll whose position is to be controlled. The cross member 93 of the lower cage 47 is mounted atop the shaft 103 of the lower hydraulic actuator 49 (FIG. 5). As a result, when the hydraulic actuator 49 is actuated to move the shaft 103 vertically upwardly or downwardly, the lower cage 45 is moved upwardly or downwardly in a corresponding manner. This movement moves the inner segment 75 of the lower roll 23 in a direction transverse to the axis of the shaft 46 on which the lower pinch roll assembly is mounted.

In order to prevent twisting of the lower cage 47, a pair of parallel plates 102 extend downwardly from the cross member 93, on either side of the shaft 103 of the lower hydraulic actuator 49. The plates are slidably mounted in an open topped bracket 104, as illustrated in FIG. 5. The lower hydraulic actuator 49 is centered in the open topped bracket 104. The plates and the bracket 104 maintain vertical alignments, as well as reduce twist.

Also illustrated in FIG. 7 is a position sensor 105 having a vertically movable shaft 107. The free end of the shaft 107 is affixed to the lower cage 47. As a result, when the lower cage moves vertically, the sensor's shaft 107 moves vertically, whereby the output of the sensor changes. Thus, the position sensor senses the position of the lower cage 47 as it is moved upwardly and downwardly by the hydraulic actuator 49; and, hence, the position of the inner segment 75.

The upper cage 45 is substantially identical to the lower cage 47, except that it is inverted, and except that the shafts 99 do not span the entire distance between the sidewalls 91 because such spanning might result in the shafts impinging on the fixed position segment 61 of the upper pinch roll. Rather, the shafts extend outwardly from only the wall 91 adjacent to the inner segment 65. As with the lower cage 47, rollers are mounted on the shafts, and the rollers impinge on the outer periphery of the inner segment 65, as the upper hydraulic actuator 53 moves the upper cage 45 upwardly or downwardly (or as the upper cage reacts against a spring force as a result of force applied against the upper segment 65 by the lower segment 75). The bracket 51 supporting the upper hydraulic actuator 53 is open at the bottom and adapted to receive the alignment plates projecting upwardly from the cross member of the upper cage 45.

Figure 8:
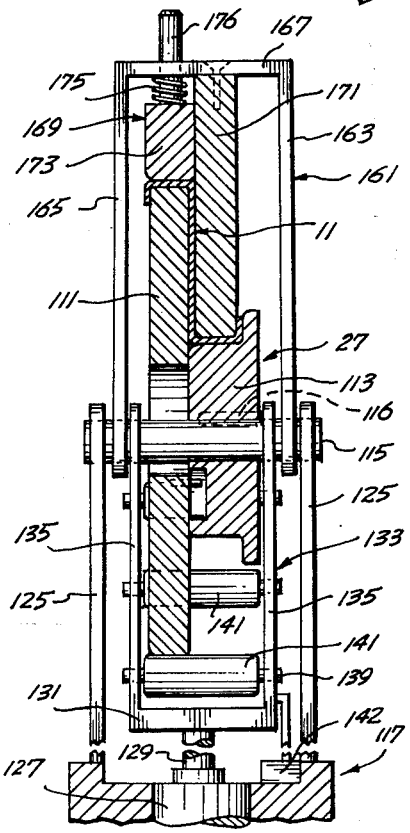
FIG. 8 is a cross-sectional view along line 8—8 of FIG. 5.

FIG. 8 is a cross-sectional view along line 8—8 of FIG. 5 and illustrates the right hand forming roll and a related mechanism adapted to cause the forming roll to follow changes in the web height of a part as the part moves through a pinch roll forming machine. The right hand forming roll 27 illustrated in FIG. 8 comprises an inner segment 111 and an outer segment 113. The outer segment 113 is mounted on and affixed to a shaft 115 by a key 116 positioned in suitably aligned keyways. The shaft 115 is rotatably mounted in, and between, a pair of upwardly projecting legs 125 of a suitable support 117. Mounted adjacent to the outer segment 113 on the side thereof nearest to the vertical housing 43 is the inner segment 111. The inner segment includes a central aperture substantially larger in diameter than the diameter of the shaft 115, and is mounted for transverse movement with respect to the shaft 115. Even though mounted for transverse movement, the inner segment 111 rotates along with the outer segment 113 as the result of friction or a pin/slot connector. More specifically, an elongate slot is formed in the surface of the outer segment 113 facing the inner segment 111 and a pin 119 projecting outwardly from the facing surface of the outer segment 111 lies in the slot 121. The longitudinal axis of the slot is transverse to the axis of the shaft 115. As a result, when the outer segment 113 rotates, the inner segment 111 also rotates.

The diameter of the inner segment 111 of the right hand forming roll 27 is substantially larger than the diameter of the outer segment 113. Further, the outer segment includes a radially projecting flange located at its outer face. The width of the inner segment is equal to the distance between the return flange and the web of the return flange Z-shaped member to be contoured; and, the distance between the radially projecting flange of the outer segment 113 and the nearest face of the inner segment is equal to the width of the leg of the Z-shaped member.

It will be appreciated from the foregoing brief description that the right hand forming roll 27 (and the left hand forming roll 29) is substantially identical, in shape, size and method of mounting, to the lower pinch roll 23.

Mounted at the bottom of the aperture 123 defined by the legs 125 is a hydraulic actuator 127. The shaft 129 of the hydraulic actuator 127 is connected to the cross member 131 of a cage 133 formed similar to the cages encircling the upper and lower pinch rolls. More specifically, the cage 133 includes a pair of plates 135 projecting upwardly from the cross member 131. The plates 135 include U-shaped apertures, similar to the U-shaped aperture 97 illustrated in FIG. 7. The U-shaped apertures lie on either side of the lower portion of the forming roll 27 and have a plurality of shafts 139 extending between the plates, about the apertures. The shafts 139 support rollers 141 that impinge on the outer periphery of the inner segment 111 of the forming roll 27. As a result, as the shaft 129 of the hydraulic actuator 127 is moved vertically, the cage 133 and, thus, the inner segment 111 is moved vertically. Hence, the hydraulic actuator 127 controls the position of the movable segment 111.

FIG. 8 illustrates a position sensor 142 located at the bottom of the aperture 123 formed in the support 117. The position sensor includes a vertically movable shaft 143 affixed to the cage 133. The position sensor senses the position of the cage 133 as it is moved upwardly or downwardly by the hydraulic actuator 127 and controls the magnitude of a signal in accordance therewith.

In order to prevent the part from twisting away from the forming roll during contouring, a modified distortion preventing mechanism of the type described in U.S. Patent 3,906,765 is provided. The distortion preventing mechanism is illustrated in FIG. 8 and includes an inverted U-shaped frame 161. The lower ends of the legs 163 and 165 of the frame 161 are rotatably mounted on the shaft 115. Projecting downwardly from the cross member 167 of the frame 161 is a segmented shoe 169. The segmented shoe includes an outer segment 171 that lies above the outer forming roll segment 113 and is fixed in position. The outer segment 171 lies between the web of the Z-shaped part and the return flange. The other or inner segment 173 of the shoe 169 is biased downwardly by a spring 175. The spring presses this segment against the upper surface of the inwardly projecting flange of the Z-shaped part. The spring, which is aligned by a vertical pin 176, allows the inner segment 173 to move upwardly and downwardly as the height of the web changes. The shoe 169 is formed such that it outlines the outer profile of the structural member or part to be contoured, whereby an orifice is created between the shoe 169 and the forming roll 27 similar to the orifice formed between the upper and lower pinch rolls, previously described.

It will be appreciated from the foregoing description that the invention provides improved pinch roll forming machines adapted to contour elongate, tapered structural members. Because changes in web height are "tracked" or followed as such parts move through the machine, support is always provided in part regions critical to obtaining the desired contour. While segmented roll assemblies suitable for tracking return flange Z-shaped members have been specifically illustrated and described, the invention is not limited to contouring only members having such a cross-sectional shape. Other cross-sectionally shaped members can also be contoured. All that is required to contour such other members is to configure the segments of the various rolls, such that they define the peripheral outline of the cross-sectional configuration of the part to be contoured; and, track height changes as they occur.

As previously noted, the present invention is also useful to improve pyramid roll forming machines. In this regard, FIG. 9 is a pictorial diagram illustrating a numerically controlled pyramid roll forming machine.

The pyramid roll forming machine pictorially illustrated in FIG. 9 includes an upper roll 201 and a pair of lower rolls 203 and 205. The lower rolls 203 and 205 are located, vertically, beneath the upper roll 201 and on either side thereof. As will be readily understood by those familar with pyramid roll forming machines, as a part or structural member 207 is moved between the upper roll 201 and the lower rolls 203 and 205 the part 207 is contoured, assuming the rolls are suitably positioned. The part is moved by the application of rotary power to all three rolls. The rae of movement of the part 207 through the pyramid roll forming machine is sensed by a suitable rate sensor 209, which may take the form of a shaft encoder.

Also illustrated in FIG. 9 is a controller 211 and a tape reader 213. The controller is connected to receive signals produced by the tape reader 213. In addition, the controller is connected to the upper roll 201 so as to control the vertical position thereof; and, to receive signals from a suitable sensor mounted so as to sense the position of the upper roll. The output of the rate sensor 209 is also connected to the controller 211. In a known manner the controller 211 compares the control signals received from the tape reader with the upper roll position sensor signals at a rate related to the output of the rate sensor. When a variation between control signal position and sensed position occurs, the controller produces an error signal that causes a hydraulic or other actuator to move the upper roll 201 to a position such that the error signal is nulled out. In this manner, the position of the upper pinch roll 201 and, hence, resulting part contour is controlled.

In accordance with the invention, a pyramid roll forming machine of the type just described is modified by forming the upper roll 201 and each of the lower rolls 203 and 205 of segments. As with the pinch roll forming machine, at least one segment of each roll is position adjustable; and its position is sensed. As a result, in accordance with this invention, the controller 211 also receives position signals related to the position of the position controllable segments and control signals related to the desired segment positions from the tape reader. The related received information is compared at the rate sensor rate; and, resultant error signals are used to control the position of the segments.

FIGS. 10 and 11 illustrate the pertinent portions of the mechanical mechanism of a pyramid roll forming machine modified in accordance with the invention so that it is suitable for contouring elongate tapered parts, as well as linear parts. FIG. 10 includes a lower frame member 221 supporting a pair of lower forming rolls 203 and 205. A suitable power source (not shown) is connected to drive the lower rolls. The lower rolls 203 and 205 are segmented in a manner similar to the segment formation of either the forming rolls 25 and 27 or the pinch rolls 21 and 23 of the pinch roll forming machine previously described. That is, each roll includes at least one segment affixed to its related shaft; and, at least one transversely movable segment pinned to the first segment. As a result, each lower roll includes a segment that is movable upwardly and downwardly.

Surrounding the lower outer periphery of each lower roll is a lower cage 223. Mounted beneath each lower cage 223, and affixed to the lower frame 221, is a hydraulic actuator 225. Each hydraulic actuator 225 is positioned such that its shafts are vertical. The upper ends of the hydraulic actuator shafts are connected to their related cage 223. As a result, the cages are moved vertically upwardly and downwardly by the hydraulic actuators, similar to the way the cages of the pinch roll forming machine previously described were moved. The cages are also formed in a similar manner, i.e., they support shafts on which rollers are mounted. The rollers, in turn, impinge on the outer periphery of the movable segment of the lower roll 203 or 205 with which a particular cage is associated.

Position sensors 226, such as linear potentiometers, are mounted on the lower frame 221 and have their movable elements, e.g., sliders or shafts 226 attached to a related cage 223. As the shaft positions change as a result of cage position changes, the output of the position sensors change; or the level of signals controlled by the position sensors charge. A rate sensor 229, also illustrated in FIG. 10, is attached to the lower frame 221 between the lower pyramid rolls 203 and 205 The rate sensor may be a shaft encoder. In any event, the rate sensor senses the movement of a part as it is moved by the upper and lower rolls.

Mounted atop the lower frame 221 is an upper frame 231. The upper frame is inverted and U-shaped.

Mounted between the legs of the upper frame 221 is a vertically movable slide block 233. The upper pyramid roll 201 is rotatably mounted on the block 233 so as to lie above and between the lower rolls 203. An upper cage 239 surrounds the upper, outer periphery of the upper roll 201. The upper cage 239 is affixed to the lower end of the vertically oriented shaft 241 of a hydraulic actuator 243 mounted on the block 233, above the case. The lower end of the shaft 245 of a position sensor 251, also having its housing affixed to the block 233, is attached to the cage 239. As a result, as the hydraulic actuator 243 moves the upper cage 239 upwardly and downwardly, the position sensor 251 provides or controls a position signal having a value related to the position of the upper cage.

Mounted atop the upper housing 231 is a main hydraulic actuator 253. The main hydraulic actuator 253 includes a vertical shaft 255 having its lower end attached to the block 233. Movement of the shaft 255 causes the entire block and thus, the entire upper pyramid roll 201 to move vertically. In addition, a main position sensor 257 having a vertically oriented shaft 259 is attached to one leg of the frame 231. One end of the shaft 259 is attached to the block 233. Since the main position sensor senses the position of the block, in effect, it senses the position of the shaft of the upper roll.

As illustrated in FIG. 11, for a Z-shaped part or structural member, the upper pyramid roll 201 is formed of two segments 201*a* and 201*b* and the lower pyramid rolls 203 or 205 are formed of a pair of segments 203*a* and 203*b* or 205*a* and 205*b*. As with the pinch roll forming machine, one of the segments of each set of rolls is affixed to its related upper or lower shaft and the other segment is vertically movable by the related cage. Also, as with the pinch roll forming machine, the number of segments (and their illustrated size and shape) should not be construed as limiting. Rather other types of segmented rolls can be used, depending upon the size and cross-sectional configuration of the part to be contoured.

It will be appreciated from the foregoing description that the invention improves pyramid roll forming machines by making them suitable for forming tapered elongate parts or structural members as well as linear elongate parts. Since the specific segment/cage coupling arrangement is identical to that used in the pinch roll forming machine embodiment described in detail above, a duplicate description is not provided here. However, the basic method of operation, i.e., the utilization of a cage to control the position of transversely movable segments of the forming rolls, is the same.

While preferred embodiments of the invention have been illustrated and described, it will be appreciated by those skilled in the art and others that various changes can be made without departing from the spirit and scope of the invention. In this regard, as discussed above various other types of segmented roll configurations and drive systems can be used. Also, other cage structures can be used, depending upon the nature and size of the member to be contoured. Hence, the invention can be practiced otherwise than as specifically described herein.

The embodiments of the invention in which an exclusive property or privilege is claimed are defined as follows:

1. A pinch roll forming machine for contouring elongate, structural members or parts comprising:

a pair of adjacent pinch rolls, each of said pinch rolls being formed of at least two segments, both of said segments of each pinch roll being mounted for rotation about a related rotational axis, one of said segments of each pinch roll being mounted for transverse movement with respect to its related rotational axis, the movable segments of said pair of pinch rolls being aligned with one another;

pinch roll movement means mounted so as to impinge on and move the movable segment of one of said pair of pinch rolls in a direction transverse to the related rotational axis of said one of said pair of pinch rolls;

at least one forming roll spaced from said pair of adjacent pinch rolls, said forming roll being formed of at least two segments, both of said segments being mounted for rotation about a related rotational axis, one of said segments also being mounted for transverse movement with respect to said related rotational axis;

forming roll movement means mounted so as to impinge on and move the movable segment of said at least one forming roll in a direction transverse to the related rotational axis of said at least one forming roll; and, position control means: (a) connected to said forming roll to control the position of said forming roll along one or more forming axes; (b) connected to said pinch roll movement means to control the position of said movable segment of said one of said pair of pinch rolls in a direction transverse to the related rotational axis of said one pinch roll; and, (c) connected to said forming roll movement means to control the position of said movable segment of said at least one forming roll in a direction transverse to the related rotational axis of said at least one forming roll.

2. A pinch roll forming machine as claimed in claim 1 wherein:

said pinch roll movement means includes a first cage surrounding at least a portion of the outer periphery of said movable segment of one of said pair of pinch rolls and a first actuator coupled to said first cage for moving said first cage in a direction transverse to the related rotational axis of said at least one of said pair of pinch rolls; and, said forming roll movement means includes a second cage surrounding at least a portion of the outer periphery of said movable segment of said at least one forming roll and a second actuator coupled to said second cage for moving said second cage in a direction transverse to the related rotational axis of said at least one forming roll.

3. A pinch roll forming machine as claimed in claim 2 including a first position sensor mounted so as to sense the position of said first cage and control the level of a first position signal in accordance therewith; and, a second position sensor mounted so as to sense the position of said second cage and control the level of a second position signal in accordance therewith.

4. A pinch roll forming machine as claimed in claim 3 wherein said position control means includes:

a source of numerical control signals for producing at least a first control signal suitable for controlling the position of said movable segment of said one of said pair of pinch rolls in a direction transverse to the related rotational axis of said at least one pinch roll and a second conrol signal suitable for controlling the position of the movable segment of said at least one forming roll in a direction transverse to the related rotational axis of said at least one forming roll; and, a numerical controller connected to said source of numerical control signals for receiving said first and second control signals and to said first and second position sensors for receiving said first and second position signals, for comparing said first and second control signals with said first and second position signals, respectively, and in accordance therewith producing first and second actuator error signals, said numerical controller connected to said first and second actuators so as to control said first and second actuators and, thereby, control the position of said first and second cages in accordance with said first and second error signals, respectively.

5. A pinch roll forming machine as claimed in claim 4 including a rate sensor mounted so as to sense the rate of movement of a structural member or part through said pinch roll forming machine, the output of said rate sensor connected to said numerical controller, said numerical controller comparing said first and second control signals with said first and second position signals at a rate related to the rate of movement of said structural member or part through said pinch roll forming machine, as determined by the output of said rate sensor.

6. A pinch roll forming machine for contouring elongate, structural members or parts comprising:

a pair of adjacent pinch rolls, each of said pinch rolls being formed of at least two segments, both of said segments of said pinch roll being mounted for rotation about a related rotational axis, one of said segments of each pinch roll being mounted for transverse movement with respect to its related rotational axis, the movable segments of said pair of pinch rolls being aligned with one another;

pinch roll movement means mounted so as to impinge on and move the movable segment of one of said pair of pinch rolls in a direction transverse to the related rotational axis of said one of said pair of pinch rolls;

a first forming roll spaced from said pair of adjacent pinch rolls, said first forming roll being formed of at least two segments, both of said segments being mounted for rotation about a related rotational axis, one of said segments also being mounted for transverse movement with respect to said related rotational axis;

first forming roll movement means mounted so as to impinge on and move the movable segment of said first forming roll in a direction transverse to the related rotational axis of said first forming roll;

a second forming roll spaced from said pair of adjacent pinch rolls on the side opposite said first forming roll, said second forming roll being formed of at least two segments, both of said segments being mounted for rotation about a related rotational axis, one of said segments also being mounted for transverse movement with respect to said related rotational axis;

second forming roll movement means mounted so as to impinge on and move the movable segment of said second forming roll in a direction transverse to the related rotational axis of said first forming roll; and, position control means: (a) connected to said first and second forming rolls to control the position of said first and second forming rolls along one or more forming axes; (b) connected to said pinch roll movement means to control the position of said movable segment of said one of said pair of pinch rolls in a direction transverse to the related rotational axis of said one pinch roll; (c) connected to said first forming roll movement means to control the position of said movable segment of said first forming roll in a direction transverse to the related rotational axis of said first forming roll; and, (d) connected to said second forming roll movement means to control the position of said movable segment of said second forming roll in a direction transverse to the related rotational axis of said second forming roll.

7. The pinch roll forming machine as claimed in claim 6 wherein:

said pinch roll movement means includes a first cage surrounding at least a portion of the outer periphery of said movable segment of said one of said pair of pinch rolls and a first actuator coupled to said first cage for controlling the position of said first cage;

said first forming roll movement means includes a second cage coupled to said movable segment of said first forming roll and a second actuator coupled to said second cage for controlling the position of said second cage; and, said second forming roll movement means includes a third cage coupled to said movable segment of said second forming roll and a third actuator coupled to said third cage for controlling the position of said third cage.

8. A pinch roll forming machine as claimed in claim 7 including:

a first position sensor mounted so as to sense the position of said first cage and control the level of a first position signal in accordance therewith;

a second position sensor mounted so as to sense the position of said second cage and control the level of a second position signal in accordance therewith; and, a third position sensor mounted so as to sense the position of said third cage and control the level of a third position signal in accordance therewith.

9. A pinch roll forming machine as claimed in claim 8 wherein said position control means includes:

a source of numerical control signals for producing a first control signal suitable for controlling the position of said movable segment of said one of said pair of pinch rolls in a direction transverse to the related rotational axis of said one of said pair of pinch rolls; a second control signal suitable for controlling the position of said movable segment of said first forming roll in a direction transverse to the related rotational axis of said first forming roll; and, a third control signal suitable for controlling the position of said movable segment of said second forming roll in a direction transverse to the related rotational axis of said second forming roll; and, a numerical controller connected to said first, second and third position sensors and to said source of numerical control signals for comparing said first, second and third position signals with said first, second and third control signals, respectively, and for producing first, second and third actuator error signals in accordance therewith, said numerical controller connected to said first, second and third actuators in a manner such that said first, second and third error signals are applied to said first, second and third actuators in a manner such that said first, second and third actuators move said first, second and third cages in accordance with said first, second and third actuator error signals, respectively.

10. A pinch roll forming machine as claimed in claim 9 including a rate sensor mounted so as to sense the rate of movement of a structural member or part through said pinch roll forming machine, the output of said rate sensor connected to said numerical controller, said numerical controller comparing said first, second and third position signals with said first, second and third control signals, respectively, at a rate related to the rate of movement of a structural member or part through said pinch roll forming machine as sensed by said rate sensor.

11. A pyramid roll forming machine for contouring elongate, tapered structural members or parts comprising:

a set of pyramid rolls, including an upper pyramid roll and a pair of lower pyramid rolls, each of said upper and pair of lower pyramid rolls being formed of at least two segments, both of said segments of each of said upper and pair of lower pyramid rolls being mounted for rotation about a related rotational axis, one of said segments of each of said upper and pair of lower pyramid rolls being mounted for transverse movement with respect to its related rotational axis, the movable segments of said upper and pair of lower pyramid rolls being aligned with one another;

pyramid roll movement means mounted so as to impinge on and move the movable segments of said upper and said pair of lower pyramid rolls in directions transverse to the related rotational axes of said upper and said pair of lower pyramid rolls; and, position control means connected to: (a) said upper pyramid roll for controlling the vertical position of said upper pyramid roll; and, (b) said pyramid roll movement means for controlling the position of said movable segments of said upper and pair of lower pyramid rolls in directions transverse to the related rotational axes of said upper and pair of lower pyramid rolls.

12. A pyramid roll forming machine as claimed in claim 11 wherein said pyramid roll movement means includes:

a first cage surrounding at least a portion of the outer periphery of said movable segment of said upper pyramid roll and a first actuator coupled to said first cage for controlling the position of said first cage;

a second cage surrounding at least a portion of the outer periphery of said movable segment of one of said pair of lower pyramid rolls and a second actuator coupled to said second cage for controlling the position of said second cage; and, a third cage surrounding at least a portion of the outer periphery of said movable segment of said other of said pair of lower pyramid rolls and a third actuator coupled to said third cage for controlling the position of said third cage.

13. A pyramid roll forming machine as claimed in claim 12 including:

a first position sensor mounted so as to sense the position of said first cage and control the level of a first position signal in accordance therewith;

a second position sensor mounted so as to sense the position of said second cage and control the level of a second position signal in accordance therewith; and, a third position sensor mounted so as to sense the position of said third cage and control the level of a third position signal in accordance therewith.

14. A pyramid roll forming machine as claimed in claim 13 wherein said position control means includes:

a source of numerical control signals for producing a first control signal suitable for controlling the position of the movable segment of the upper pyramid roll, a second control signal suitable for controlling the position of said one of said pair of lower pyramid rolls and a third control signal suitable for controlling the position of the other of said pair of lower pyramid rolls; and, a numerical controller, said numerical controller connected to said first, second and third position sensors for receiving said first, second and third position signals and to said numerical controller for receiving said first, second and third control signals, said numerical controller comparing said first, second and third position signals with said first, second and third control signals, respectively, and, in accordance therewith, producing first, second and third error signals, said first, second and third error signals being applied to said first, second and third actuators so as to control said first, second and third actuators, respectively, in accordance with said first, second and third error signals.

15. A pyramid roll forming machine as claimed in claim 14 including a rate sensor mounted so as to sense the rate of movement of a structural member or part through said pyramid roll forming machine, the output of said rate sensor connected to said numerical controller, said numerical controller comparing said first, second and third position signals with said first, second and third control signals at a rate related to the rate of movement of a structural member or part through said pyramid roll forming machine as determined by said rate sensor.

16. In a rolling machine for contouring elongate parts as said parts are moved past a plurality of contouring rolls, at least one of which is position adjustable along at least one forming axis, the improvement comprising:

fashioning each of said plurality of contouring rolls from at least two segments located side-by-side along the axis of rotation of the related contouring roll, selected ones of said segments being transversely movable with respect to the axis of rotation of the related contouring roll; and, movement means coupled to predetermined ones of said transversely movable segments of said plurality of contouring rolls for instantaneously controlling the position of said predetermined ones of said transversely movable segments.

17. The improvement claimed in claim 16 including: position sensing means for sensing the position of said predetermined ones of said transversely movable segments of said contouring rolls and producing position signals related to the actual position of said predetermined ones of said transversely movable segments; and, a controller suitable for receiving control signals denoting the desired position of said predetermined ones of said transversely movable segments of said contouring rolls and connected to said position sensing means for receiving said position signals related to the actual position of said predetermined ones of said transversely movable segments, said controller comparing said control signals with said position signals and in accordance therewith, applying error signals to said movement means, said error signals being suitable for causing said movement means to move said predetermined ones of said transversely movable segments to the desired position denoted by said control signals.

18. The improvement claimed in claim 17 wherein said movement means includes cages surrounding at least a portion of the outer periphery of said predetermined ones of said transversely movable segments of said contouring rolls and actuators coupled to said cages for controlling the position of said cages, said actuators being connected to said controller for receiving said error signals and, in accordance therewith, controlling the position of said cages and, thus, the position of said predetermined ones of said transversely movable segments.

* * * * *

UNITED STATES PATENT AND TRADEMARK OFFICE

CERTIFICATE OF CORRECTION

PATENT NO. : 4,117,702

DATED : October 3, 1978

INVENTOR(S) : Gene B. Foster

It is certified that error appears in the above-identified patent and that said Letters Patent are hereby corrected as shown below:

Column 3, line 25, delete "improvement" and insert —improved—.
Column 3, line 62, delete "suited" and insert —suitable—.
Column 4, line 2, delete "are" and insert —is—.
Column 5, line 15, delete "Web" and insert —web—.
Column 7, line 7, delete "segments" and insert —segment—.
Column 7, line 7, delete "segmments" and insert —segments—.
Column 8, line 53, delete "65 segment" and insert —segment 65—.
Column 11, line 57, delete "rae" and insert —rate—.
Column 15, line 34, delete "said" and insert —each—.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*